United States Patent [19]

McDonald

[11] 4,201,431

[45] May 6, 1980

[54] UNIVERSAL ADAPTABLE THREE-PRONG ELECTRICAL PLUG

[76] Inventor: Ronald T. McDonald, 102 Warren Ave., Marlboro, Mass. 02148

[21] Appl. No.: 919,864

[22] Filed: Jun. 28, 1978

[51] Int. Cl.[2] ..... H01R 3/06

[52] U.S. Cl. ..... 339/14 P; 339/31 R; 339/176 R; 339/195 A

[58] Field of Search ..... 339/14 RP, 14 P, 18 P, 339/31 R, 176 R, 195 A

[56] References Cited

U.S. PATENT DOCUMENTS 3,299,390 1/1967 Eckelkamp ..... 339/14 RP

*Primary Examiner*—Roy Lake
*Assistant Examiner*—DeWalden W. Jones
*Attorney, Agent, or Firm*—Herbert L. Gatewood

[57] ABSTRACT

A three-prong electrical plug for power tools and other electrical equipment is provided which can be used with either a 3- or 2-wire electrical outlet. One portion of the body of the plug containing the ground prong is detachably connected to another portion of the plug containing the two electric contact blades. When disconnected from one another, the plug body components can be then offset with respect to one another and connected together again in a predetermined second location. In this combination, the ground prong is located to contact the grounded screw of an electrical receptacle on inserting of the two electric blades of the plug into the receptacle, thus automatically grounding the electrical equipment.

8 Claims, 4 Drawing Figures

UNIVERSAL ADAPTABLE THREE-PRONG ELECTRICAL PLUG

BACKGROUND OF THE INVENTION (1) Field of the Invention

This invention relates to electrical connector plugs, and more particularly to improved 3-wire, automatic grounding type connector plugs.

(2) Description of the Prior Art

The hazard of operating ungrounded electrical devices is well recognized. As a result, the Underwriter's Laboratories, Inc. and many electrical codes long have required that all portable electrical tools be equipped with suitable grounding means. In the beginning, this requirement was satisfied by the use of a commonly called "pig-tail" connection in the form of a wire coming out of one side of the plug, and which had been connected to one of the blades of the plug, terminating in a contact for attachment to a neutral ground lead, such as the box carrying the receptacle.

More recently, the "Underwriter's" have required that a plug for electrical devices be equipped with a three-prong plug for insertion into a 3-wire receptacle. Although this is a desirable objective from a safety standpoint, the fact is that many buildings where electrical devices might be used have only 2-wire electrical outlets. That, of course, presents a problem to manufacturers of portable electrical tools and other equipment. Moreover, when users of portable tools having a three-prong plug have encountered a 2-wire outlet, they have often reacted by breaking off the ground prong in order to use the electrical device. This, of course, not only destroys the usefulness of the 3-wire plug where a three-prong outlet is later encountered, but results in an unsafe condition.

To overcome the problem presented, i.e., how do you use a three-prong plug with a 2-wire receptacle, a variety of adapters or conversion plugs have been invented having only two blades. A three-prong plug is then plugged into the adapter which in turn is plugged into the 2-wire receptacle. One such adapter is provided with a "pig-tail" connected at one end to a ground connection in the adapter and terminating at the other end in a ground contact which can be connected to the ground screw on the 2-wire electrical outlet. While these adapters are satisfactory to a degree, in many instances a user does not have a screwdriver available in which to make the connection. And in many instances, the user of the portable tool may not even have an adapter readily available.

Over the years, a variety of three-prong plugs have been developed which make unnecessary the use of an adapter, as above-described. Examples of prior art patents disclosing various convertible three-prong plugs are U.S. Pat. Nos. 2,323,736; 2,922,134; 2,986,718; 2,876,426; 3,134,631; 3,178,667; 3,219,962; and 2,984,808.

As disclosed in U.S. Pat. No. 2,323,736, there is shown a three-prong plug in which the ground prong is capable of being retracted from a position of use, depending on whether or not a 3-wire electrical outlet is encountered. When retracted for use with a 2-wire outlet, however, this leaves the electrical device with which the plug is associated ungrounded. U.S. Pat. No. 2,984,808 discloses another three-prong convertible plug in which the ground plug can be pivoted into the use position or not as desired. A "pig-tail" connection is provided on the plug, and in connection with the ground, for connection to the ground screw of a 2-wire receptacle. Another three-prong plug in which a pivotable ground prong is provided is disclosed in U.S. Pat. No. 2,986,718. A "pig-tail" is provided which connects to the ground and which is provided with a connection at the other end for connection to the ground screw in case of use with a 2-wire electrical outlet.

U.S. Pat. Nos. 2,876,426 and 2,922,134 disclose electrical connecting plugs in which a pivotable grounding element is provided. The ground prong on encountering the 2-wire outlet is pivoted so that the finger portion of the grounding prong is out of position so that the connecting plug can be used. In U.S. Pat. No. 2,876,426, the other end of the pivoted prong is constructed so that on the prong being pivoted, it is in contact with the grounded receptacle plate and, in turn, grounds the electrical device.

U.S. Pat. No. 3,134,631 discloses another three-prong electrical plug in which the ground prong is pivotable out of position in case the plug is used with a 2-wire electrical outlet. The ground prong is provided with a groove adjacent its free end for insertion of a ground wire which in turn can be connected to a ground lead in the electrical outlet. A further electrical plug in which is provided a pivotable prong is disclosed in U.S. Pat. No. 3,178,667. When a 2-wire outlet is encountered, the pivotable ground prong therein is resiliently urged against the face plate of the receptacle to establish a ground, thereby reducing the possibility of a shock being transmitted to the user of an electrical device.

U.S. Pat. No. 3,219,962 discloses an electrical connector plug in which a pivotable ground prong is provided and which is disclosed for use with either a 2 or 3-wire receptacle. The ground plug is biased to its operative position.

While all of the electrical plugs as above disclosed are suitable to a degree, their use does involve certain problems and disadvantages. In some cases, no ground is provided for at all, making for an unsafe condition. Where a "pig-tail" is used to provide connection to a ground screw, this necessitates removal or at least loosening a receptacle ground screw. However, many times a screwdriver is not readily available. In any event, it makes use of a ground less likely because grounding is not readily accomplished without the user taking some further action other than merely pushing the plug into the outlet. Where grounding is to be accomplished by a pivotable ground prong making contact with an electrical receptacle face plate, certain mechanical problems sometimes result. The biasing mechanism sometimes, particularly after use for some time, does not properly bias the ground prong against the face plate, thereby providing no ground.

SUMMARY OF THE INVENTION

The invention disclosed and claimed herein in its basic aspects is a self-grounding electrical connector plug comprising a plug body member comprising a first body member component in which is fixedly mounted a grounding prong capable of detachable mating combination with a second body member component in two different predetermined locations and in which is fixedly mounted two electrical contact blades, the first mating combination providing a three prong electrical connector and the second mating combination providing a connector plug capable of automatic grounding for use with a two wire electrical outlet.

In a more preferred aspect of the invention, the first body member component mating surface is provided with at least one projection and the mating surface of the second body member component mating with the first body member component comprise at least one complementary cavity, at each mating location, the projection and cavity at each location mating in male and female fashion and providing a detachable combination. The projection and cavities are so located in their respective body member components as to provide in one mating combination a conventional three prong connector plug, and in the other mating combination a connector plug suitable for use with a two wire receptical but providing means for grounding.

Quite advantageously, the connector plug of the invention provides automatic grounding with either a 2 or 3-wire outlet. This is accomplished quite easily and readily by the user of an electrical device by providing the first body member component of the plug at one location or the other on the second body member component, depending on whether a 2 or 3-wire outlet is encountered. Conversion of the plug according to the invention for use with either a 2-wire or 3-wire outlet is easily accomplished and does not require a screwdriver or other tool.

BRIEF DESCRIPTION OF THE DRAWING

The invention will be best understood in the following detailed description of a preferred embodiment thereof, taken in connection with the appended drawings in which.

DETAILED DESCRIPTION OF THE INVENTION AND THE PREFERRED EMBODIMENTS

Figure 1:
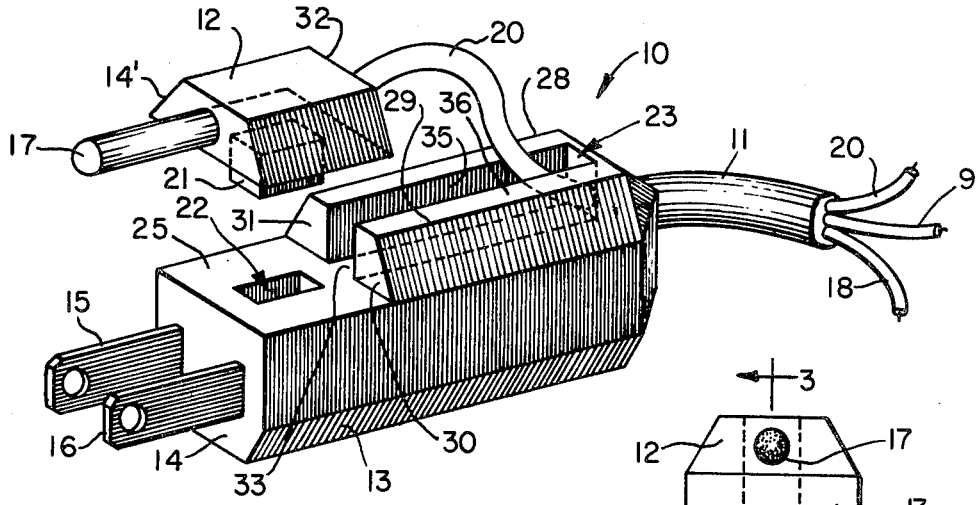
FIG. 1 is a perspective view of a connector plug in accordance with the invention showing the first body member component detached for use with a 3-wire outlet from its location with the second body member.
Figure 2:
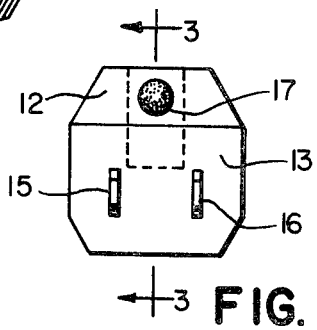
FIG. 2 is an end view of the mating combination of the invention providing a three prong electrical connector plug shown in FIG. 1, taken from the operative end.
Figure 3:
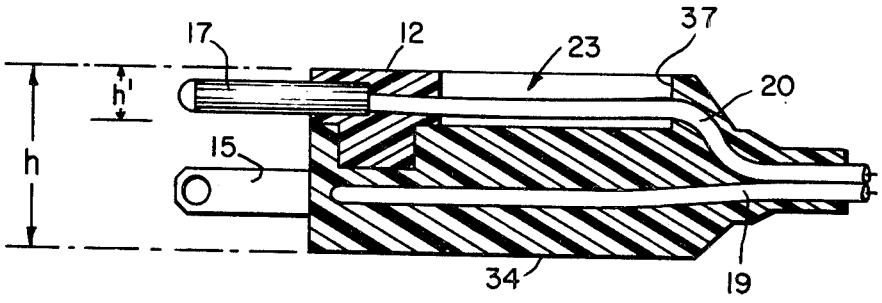
FIG. 3 is a sectional view of the three prong combination plug shown in FIG. 2, taken along secant line 3—3.

Turning now to the drawing, there is shown therein in FIG. 1 a self-grounding electric connector plug 10 connected in conventional fashion at the end of a conventional 3-wire electric conductor cord 11 connected to an electrical device (not shown) such as a portable hand tool. As shown in the drawing, electric connector plug 10 comprises a first body member component 12 capable of detachable mating combination with a second body member component 13 in two different predetermined locations hereinafter more fully described. Connector plug 10 has a planar vertical front end comprising faces 14, 14' from which protrudes two electric contact elements shown as blades 15,16, and ground prong 17, respectively. Blades 15, 16 are fixedly mounted within the body of body member component 13. At the inner end of each blade, as shown in the drawing, is connected an electric conducting wire 18, 19 which terminates at the electrical device, not shown, according to usual practice. To the end of ground prong 17, fixedly mounted in body member component 12, is connected the grounding or third wire 20 also connected to the electrical device or tool. The connections with the electric conducting wires and ground wire can be accomplished by a variety of means well known in the art; e.g., soldered and screw connections.

Electric plug body member component 12, as shown in the drawing, is capable of detachable mating connection with second body member component 13 in two different predetermined locations so as to make the connector plug 10 suitable for use with either a two or three wire electrical outlet. Although the mating of body member component 12 with body member component 13 can be accomplished by various means, satisfactory results will be found where a projection is provided from one body component member or the other, e.g., the projection 21 from body member component 12, that mates with a cavity in the other body member component, e.g., the cavities 22, 23 in body member component 13.

As shown in the drawing projection 21 extends perpendicularly outwardly from bottom planar horizontal surface 24 of first body member component 12 and intrudes into dead cavity 22 of complementary configuration in the top surface 25 in body member component 13. Surfaces 24, 25 are planar and mate with one another. The depth of cavity 22 should be sufficient to allow projection 21 to enter therein and permit mating contact between planar surface 24, 25.

Cavity 23 (also preferably a dead cavity) is provided longitudinally of body member 13, extending from a point adjacent its rear toward the front. Its length is of no particular consequence; however, its location on body member 13 must be such as to direct ground prong 17 against the grounding screw 26 in electrical outlet plate 27, when body member component 12, 13 are in the mating combinating shown in FIG. 4 of the drawing. Mating surfaces 28, 29 are planar, and in the same plane. The depth of cavity 23 must be sufficient to accomodate projection 21 and permit mating contact between top planar surfaces 28, 29 of body member component 13 and bottom planar mating surface 24 of body member component 12. The dimensions of cavities 22, 23 in relation to projection 21 should be such as to provide a good frictional fit, so that the two body members tightly fit together, but are still detachable from one another by hand. As will be appreciated, body member component 12 can be positioned at various locations, as desired along cavity 23, to achieve the best contact with ground screw 26.

Cavity 23 is open at the front end thereof, as shown in FIG. 1 of the drawing and terminates at front faces 30,31. These faces butt against rear face 32 of first body member component 12 in the mating combination shown in FIG. 1 and are in a plane parallel to faces 14,14'. The purpose of cavity 23 being open at the top, as will be appreciated in reference to the drawing, is to permit the movement of body member component 12 to its rearward position. The portion of ground wire 20 adjacent body member 12 must be free so that movement of the associated body member is not inhibited.

Base 33 of cavity 23 is, as is shown on the drawing, planar and parallel to planar base 34 of body member component 13. And side walls 35,36, as well as end wall 37, of cavity 23 are planar and perpendicular to planar base 33. However, as will be appreciated cavity 23 can be of any configuration so long as it complements projection 21 and permits the desired freedom of movement of ground wire 20.

Although projection 21 is shown in the drawing to have a rectangular cubic shape, it need not take that particular shape. Neither do the shapes of cavities 22,23 need be rectangular cubic. The main consideration is that the mating surfaces be complementary so as to provide a suitable detachable combination. In general, the mating surfaces will fit together male and female fashion; however, this can take various configurations. Projection 21 from body member component 12 can be parallel with face 14 and extend laterally across the width of the connector plug body. Accordingly, cavity 22 would also be parallel with face 14 and extend laterally across the width of body member component 13. However, projection 21 need not extend the full width of the body member component. Projection 21 can also, if desired, take the shape of a plurality of spaced-apart projections or pins. In this case a plurality of corresponding openings would be provided in body member 13 for intrusion of the pins. These pins or projections can be integral with body member component 12, and provided during its manufacture, or separately provided in the body member component according to the usual techniques subsequent to manufacture of the body member components.

As will be appreciated, cavity 23 must correspond in size and shape to accomodate projection 21, whatever its configuration, thus providing a second location for body member component 12 in combination with body member component 13. Moreover, an open longitudinal channel must be provided in body member component 13 which extends from the cord end of body member component 13 to the rear face 25 of body member component 12. This is necessary so that ground wire 20 which is located in channel 24 is sufficiently free for movement to permit plug body component member 12 to be disconnected from its one location with body member component 13 (FIG. 1) and connected at its other location, i.e., in cavity 23 (FIG. 4).

As shown in the drawing, the mating faces 24, 25 of body member components 12 and 13, respectively, are planar and lie in a plane perpendicular to that of faces 14, 14' and parallel with top and bottom surfaces 28, 34 of connector plug 10. However, as will be appreciated, this need not be the case. The mating faces 24, 25 can be of other configuration, if desired, e.g., a convex/concave sloping mating surfaces. In this case, of course, top surface 28 in which is provided cavity 23 must be of a suitable mating configuration. The main consideration is that whatever configuration the mating surfaces take, good mating contact is provided. There should also be good frictional engagement between projection 21 and cavities 22, 23. The length of the projection and depth of the cavity will, of course, have some influence on this, as well as the respective dimensions. These length measurements should be such that the two body member components are not accidently detached from one another, e.g., a ¼"-½" deep cavity and projection length will be found most satisfactorily.

The location of cavity 23, except where a cavity is provided as in FIG. 1, on electric plug body member component 13 is critical, as are the respective heights h, h' of the body member components in combination, and body member 12, alone. Body member component 12 must be provided in proper combination with body member component 13 in the second location i.e., at cavity 23, to accomplish grounding when a 2-wire receptacle or outlet is encountered.

Figure 4:
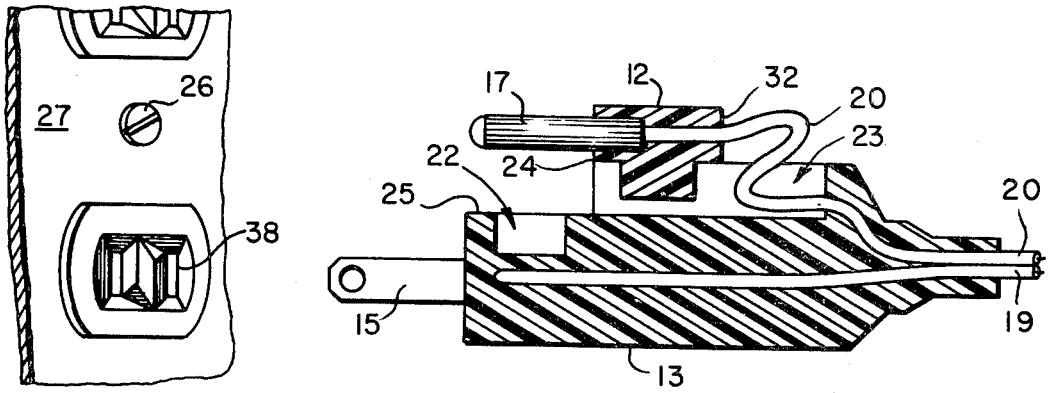
FIG. 4 is a sectional view such as is shown in FIG. 3 of the electrical connector plug of the invention but showing the first body member component in which is fixed the grounding prong displaced to its secondary location, so that the connector plug can be used with the two wire electrical outlet shown.

When a 2-wire outlet 35 is encountered as shown in FIG. 4 of the drawing, body member component 12 is disconnected from its first location (FIG. 1) and is connected to body member component 13 at its second location (FIG. 4). Thus, not only is its horizontal location on body member 13 critical, but its vertical position is important as well. This permits the blades 15, 16 to be pushed fully home into receptacle 38. On this being done, ground prong 17 will contact ground screw 26 in contact with face plate 27 of the conventional outlet box (not shown), thus automatically providing a ground for the electrical tool or other device being used.

The body member components can be of rubber or other insulating materials, for example, various plastic materials, as desired. These can be chosen to provide a relatively flexible plug body, or one more rigid. However, a somewhat flexible plug body is more preferred. Such a body can be provided by various conventional molding techniques, e.g., injection molding. In this way, the ends of the blades 15, 16 and ground prong 17 as well as their connecting wires can be fully encased in a body of nonconducting material. Of course, a portion of ground wire 20 will be left free to permit movement of body member component 12.

As many different embodiments of this invention will now have occurred to those skilled in the art, it is to be understood that the specific embodiments of the invention as presented herein are intended by way of illustration only and are not limiting on the invention, but that the limitations thereon can be determined only from the appended claims.

What I claim is:

1. A self grounding electric connector plug connected to an electrical device by a 3-wire electric conductor cord comprising two electric conducting wires and a ground wire, said electric connector plug comprising a first body member component and a second body member component for detachable assembly in combination with said first body member component, said first body member component having a vertical planar front face and a bottom mating surface for mating combination with said second body member component, said second body member component having a vertical planar front face and first and second top surfaces comprising front and back mating surfaces for detachable mating combination as desired with the mating surface of said first body member component, a ground prong fixedly mounted in said first body member component and extending outwardly from the said vertical planar front face of said first body member component, two electric contact blades fixedly mounted in said second body member component and extending outwardly from said vertical planar front face of said second body member component, said 3-wire electric conductor cord being located in said second body member component, the said two electric conducting wires of which are connected to said electric contact blades and the ground wire of which is connected to the ground prong in said first body member component, a portion of said ground wire between said first and second body member components being exposed and free to move as said first body member component is detachably connected to said front and back mating surfaces of said second body member component whereby when the mating surface of the first body member component is detachably connected to the front mating surface of said second body member component the said vertical planar front faces are in the same vertical plane and a 3-prong electric connector plug is provided, and when the mating surface of the first body member component is detachably connected to the back mating surface of the second body member component, a connector plug is provided capable of automatic grounding for use with a two wire electrical outlet, the ground prong in use of the electric plug making contact with the grounding screw in an electrical outlet plate.

2. A self-grounding electric connector plug connected to an electrical device by a 3-wire electric conductor cord comprising two electric conducting wires and a ground wire according to claim 1 wherein the said mating surfaces of the first and second body member components comprise planar surfaces, and the planar surfaces in the second body member component are in vertical planes parallel to one another.

3. A self-grounding electric connector plug connected to an electrical device by a 3-wire electric conductor cord comprising two electric conducting wires and a ground wire according to claim 2 wherein the said vertical planar front faces when the mating surface of the first body member component is detachably connected to the front mating surface of the second body member component are in a plane perpendicular to the said planes of the said mating surfaces.

4. A self-grounding electric connector plug connected to an electrical device by a 3-wire electric conductor cord comprising two electric conducting wires and a ground wire according to claim 1 wherein the said bottom mating surface of the first body member component comprises at least one projection extending downwardly from it, and the said mating surfaces of the second body member component each comprises at least one cavity projecting inwardly of the mating surface for association with the said at least one projection from the mating surface of the first body member component.

5. A self-grounding electric connector plug connected to an electrical device by a 3-wire electric conductor cord comprising two electric conducting wires and a ground wire according to claim 4 wherein the back mating surface in the second body member component comprises a longitudinal open cavity for location as desired of the said at least one projection from the mating surface of the first body member component and for location of the said exposed portion of the ground wire.

6. A self-grounding electric connector plug connected to an electrical device by a 3-wire electric conductor cord comprising two electric conducting wires and a ground wire, said electric connector plug comprising a plug body comprising a first body member component having a vertical planar front face and a bottom mating surface comprising a planar surface and at least one projection extending downwardly from said planar surface, and a second body member component having a vertical planar front face and top mating surfaces in two predetermined locations constituting front and back locations for detachable mating combination with the said mating surface of the first body member component each comprising a planar surface and at least one cavity projecting inwardly in said planar surfaces whereby said body member components can be detachably connected at the two predetermined locations as desired in male and female fashion, a ground prong fixedly mounted in said first body member component and extending horizontally from the said front face thereof, two electric contact blades fixedly mounted in said second body member component and extending horizontally outwardly from said front face of the second body member component, whereby when the mating surface of said first body member component is in detachable mating combination with the front mating surface of the second body member component a three-prong electric connector plug is provided and when in the other mating combination a connector plug is provided capable of automatic grounding when used in a two-wire electrical outlet on insertion of the plug into the outlet by contact of the ground plug with the ground screw on the outlet plate.

7. A self-grounding electric connector plug connected to an electrical device by a 3-wire electric conductor cord comprising two electric conducting wires and a ground wire according to claim 6 wherein the said at least one projection from the first body member component planar mating surface is a rectangular cubic projection extending perpendicularly outwardly from the planar mating surface and the said at least one cavity in each said planar mating surface in the second body member component is a cavity complementary to said projection.

8. A self-grounding electric connector plug connected to an electrical device by a 3-wire electric conductor cord comprising two electric conducting wires and a ground wire according to claim 7 wherein the back mating surface of the second body member component comprises an elongated open cavity and a portion of said ground wire is exposed and is located in said elongated open cavity, permitting ready freedom of movement of the first body member component with respect to the two predetermined locations for detachable mating combination on the second body member component.

* * * * *